US011778379B2

(12) United States Patent
Shih et al.

(10) Patent No.: US 11,778,379 B2
(45) Date of Patent: Oct. 3, 2023

(54) SYSTEM AND METHOD FOR OMNIDIRECTIONAL ADAPTIVE LOUDSPEAKER

(71) Applicant: Harman International Industries, Incorporated, Stamford, CT (US)

(72) Inventors: Shao-Fu Shih, San Jose, CA (US); James Zheng, Shenzhen (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 17/522,442

(22) Filed: Nov. 9, 2021

(65) Prior Publication Data

US 2023/0145713 A1 May 11, 2023

(51) Int. Cl.

| | |
|---|---|
| ***H04R 29/00*** | (2006.01) |
| ***H04R 3/12*** | (2006.01) |
| ***H04R 1/40*** | (2006.01) |
| ***H04R 3/00*** | (2006.01) |

(52) U.S. Cl.

CPC ..... *H04R 3/12* (2013.01); *H04R 1/403* (2013.01); *H04R 1/406* (2013.01); *H04R 3/005* (2013.01); *H04R 29/002* (2013.01); *H04R 2201/401* (2013.01)

(58) Field of Classification Search

CPC ..... H04R 3/005; H04R 2201/401; H04R 29/002; H04R 29/001

USPC ..... 381/56–59, 103

See application file for complete search history.

(56) References Cited

U.S. PATENT DOCUMENTS

| | | | | |
|---|---|---|---|---|
| 9,762,999 | B1 * | 9/2017 | Johnson | H04R 1/403 |
| 10,149,087 | B1 * | 12/2018 | Choisel | H04R 29/001 |
| 10,299,039 | B2 * | 5/2019 | Kriegel | H04R 29/002 |
| 10,777,214 | B1 * | 9/2020 | Shi | H04R 29/001 |
| 11,399,255 | B2 * | 7/2022 | Johnson | H04S 7/305 |
| 2018/0352324 | A1 | 12/2018 | Choisel et al. | |
| 2019/0222931 | A1 | 7/2019 | Kriegel et al. | |

OTHER PUBLICATIONS

Extended European Search Report dated Apr. 4, 2023 for European Patent Application No. 22205717.6, 8 pages.

* cited by examiner

*Primary Examiner* — Disler Paul

(74) *Attorney, Agent, or Firm* — Brooks Kushman P.C.

(57) ABSTRACT

In at least one embodiment, a system for providing an adaptive loudspeaker assembly is provided. A loudspeaker array transmits an audio output signal in an omnidirectional sound mode in a room having a plurality of walls. A microphone array is coupled to the loudspeaker array to capture the audio output signal in the room. At least one controller is programmed to receive the captured audio output signal and to determine that at least one first wall of the plurality of walls is closest to the loudspeaker array based on the captured audio output signal. The at least one controller is further programmed to change a sound mode of the loudspeaker array from transmitting the audio output signal in the omnidirectional mode into a beamforming sound mode to transmit the audio output signal away from the at least one first wall of the plurality walls.

18 Claims, 3 Drawing Sheets

SYSTEM AND METHOD FOR OMNIDIRECTIONAL ADAPTIVE LOUDSPEAKER

TECHNICAL FIELD

Aspects disclosed herein generally relate to an omnidirectional adaptive loudspeaker assembly. This aspect and others will be discussed in more detail below.

BACKGROUND

Conventional loudspeakers were designed to be directional based on its transducer radiation pattern and speaker positioning. The loudspeaker has no prior knowledge of the number of listeners will be listening and what their respective relative positioning in the space will be. In recent years, due to the advancement of voice assistance, smart homes, and working from home; loudspeakers are shifting from corners of the room into portable omnidirectional usage. Hence, the industry has started seeing a new form factor of 360-degree audio speaker emerging. This form factor may deliver 360-degree sound for consistent, uniform coverage. Namely, by placing the loudspeaker in a middle of a room where everyone may be able to perceive remarkably similar sound experience. Furthermore, in some configurations, this form factor may also be able to simulate 3D sound and perform better sound effect than a conventional Bluetooth stereo speaker.

SUMMARY

In at least one embodiment, a system for providing an adaptive loudspeaker assembly is provided. The system includes a loudspeaker array, a microphone array, and at least one controller. The loudspeaker array transmits an audio output signal in an omnidirectional sound mode in a room having a plurality of walls. The microphone array is coupled to the loudspeaker array to capture the audio output signal in the room. The at least one controller is programmed to receive the captured audio output signal and to determine that at least one first wall of the plurality of walls is closest to the loudspeaker array based on the captured audio output signal. The at least one controller is further programmed to change a sound mode of the loudspeaker array from transmitting the audio output signal in the omnidirectional mode into a beamforming sound mode to transmit the audio output signal away from the at least one first wall of the plurality walls.

In at least one embodiment, a method for providing an adaptive loudspeaker assembly is provided. The method includes transmitting, a loudspeaker array, an audio output signal in an omnidirectional sound mode in a room having a plurality of walls and capturing, via a microphone array, the audio output signal in the room. The method further includes determining with at least one controller that at least one first wall of the plurality of walls is closest to the loudspeaker array based on the captured audio output signal and changing a sound mode of the loudspeaker array from transmitting the audio output signal in the omnidirectional mode into a beamforming sound mode to transmit the audio output signal away from the at least one first wall of the plurality walls.

In at least one embodiment, a system for providing an adaptive loudspeaker assembly is provided. The system includes a circular loudspeaker array, a microphone array, and at least one controller. The circular loudspeaker array transmits an audio output signal in an omnidirectional sound mode in a room having a plurality of walls. The circular microphone array is coupled to the circular loudspeaker array to capture the audio output signal in the room. The at least one controller programmed to receive the captured audio output signal indicating a plurality of sound reflections from the plurality of walls and to determine that at least one first wall of the plurality of walls is closest to the circular loudspeaker array based on a first sound reflection from the at least one first wall being the strongest reflection out of the plurality of sound reflections. The at least one controller is further programmed to change a sound mode of the loudspeaker array from transmitting the audio output signal in the omnidirectional mode into a beamforming sound mode to transmit the audio output signal away from the at least one first wall of the plurality walls.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that the controllers as disclosed herein may include various microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, such controllers as disclosed utilizes one or more microprocessors to execute a computer-program that is embodied in a non-transitory computer readable medium that is programmed to perform any number of the functions as disclosed. Further, the controller(s) as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware-based inputs and outputs for receiving and transmitting data, respectively from and to other hardware-based devices as discussed herein.

In general, there may be two types of structures of the loudspeaker speaker product that can be claimed as 360-loudspeaker. One is an upward loudspeaker and the other is a downward loudspeaker with a waveguide design such as a reflector. While the mechanical design may be able to achieve an omnidirectional radiation pattern, when the loudspeaker is placed close to a wall or other obstacles, it may sound unnatural or colored. This may be due to near field interaction around the loudspeaker such as the reflected sound interfered with the direct sound and thus lead to frequency response alternations.

Another configuration is to position multiple transducers around a unit circle in the horizontal plane such as distributing full range drivers uniformly around the circle. This configuration enables different transducers to run different processing based on the environment and hence alleviate the coloration problem. However, the current existing market solutions are either controlled manually or fixed while on the factory floor. It makes the form factor loses its flexibility and inconvenience to the end users.

Figure 1:
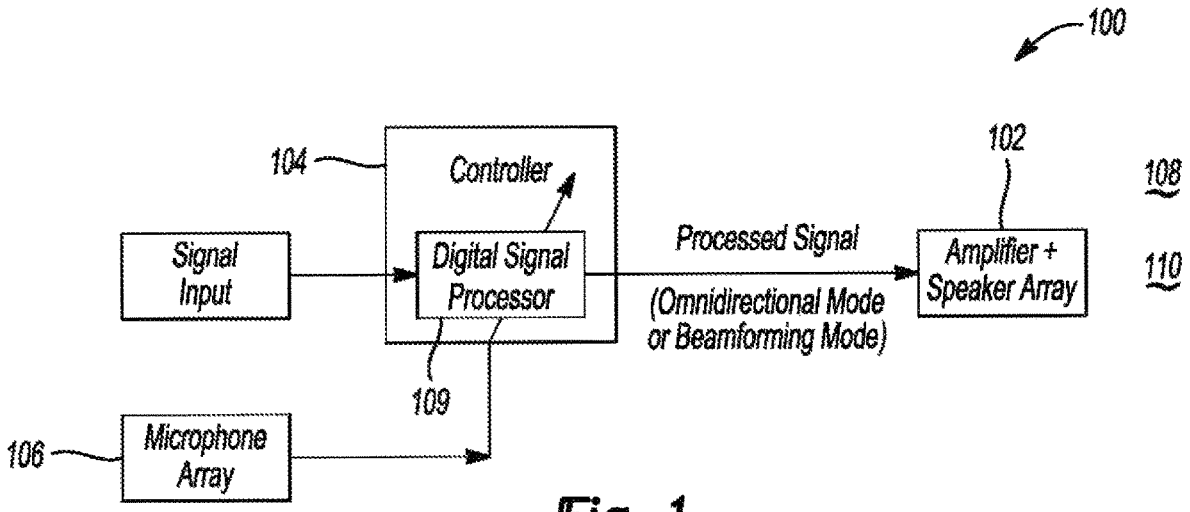
FIG. 1 depicts a system for providing an omnidirectional adaptive loudspeaker assembly in accordance with one embodiment.

FIG. 1 depicts a system 100 for providing an omnidirectional adaptive loudspeaker assembly 102 in accordance with one embodiment. The system 100 includes the loudspeaker assembly 102, a controller 104, and a microphone array 106. In general, the controller 104 includes any number of digital signal processors 109 (hereafter "digital signal processor" or "DSP" 109) and is programmed to receive an audio input signal. The controller 104 is programmed to process the audio input signal and to provide a processed audio output signal to the loudspeaker assembly 102 (or loudspeaker array 102) into a room 108 having one or more walls 110. The controller 104 may change a sound mode of the loudspeaker array 102 from an omnidirectional mode to a beamforming mode based on a location the loudspeaker array 102 relative to the closest wall 110. In the beamforming mode, the controller 104 controls the loudspeaker array 102 to radiate the processed audio output signal in a direction that is opposite to the closest wall 110. In this case, the loudspeaker array 102 may be placed anywhere in the room 108 and its relative sound mode may be adjusted automatically based on the environment of the room 108 and may still demonstrate ideal and robust audio performance.

In general, the microphone array 106 may detect audio that is being output by the loudspeaker array 102 and transmit the detected audio back to the controller 104. In turn, the controller 104 (e.g., the DSP 109) may then determine the distance (e.g., location) of the closest wall 110 to the loudspeaker array 102 and then control the sound mode of the loudspeaker array 102. This may entail transmitting the processed audio output signal from the omnidirectional mode to the beamforming mode. In general, the controller 104 determines the strongest reflection of audio from the wall 110 (i.e., the closest wall) to then either deactivate one or more loudspeakers in the array 102 that is closest to the wall 110 or apply beamforming to direct the audio output in a desired direction.

It is recognized that the loudspeaker array 102 may be implemented as a circular array of m loudspeakers that are uniformly distributed on a horizontal plane. It is also recognized that the microphone array 106 may also be implemented as a circular array of n microphones. The microphone array 106 may be positioned parallel with the loudspeaker array 102.

Figure 2:
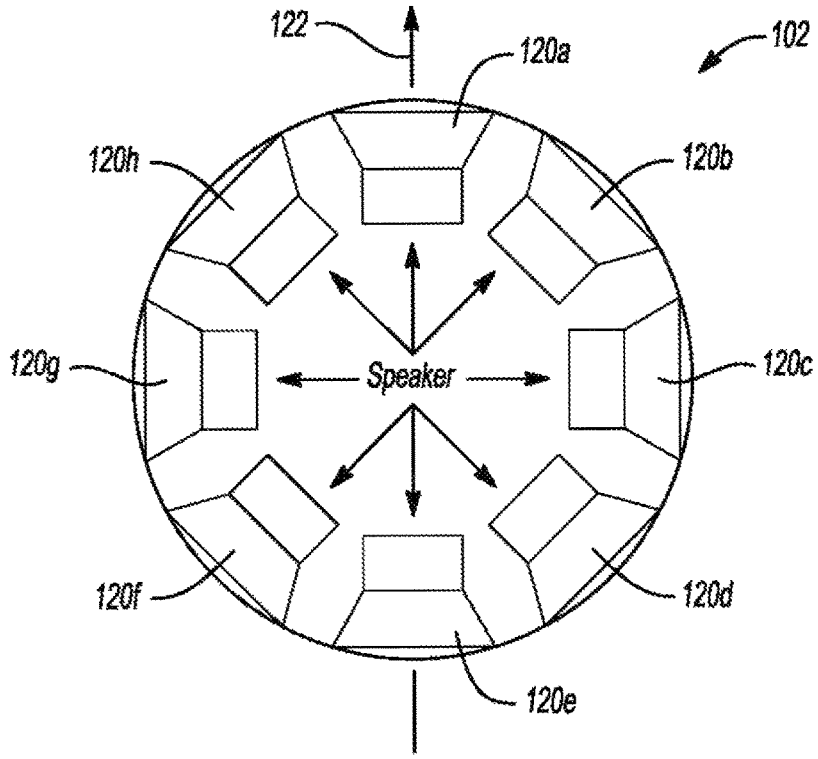
FIG. 2 depicts one example of a circular loudspeaker array that forms a portion of the system of FIG. 1 in accordance with one embodiment.

FIG. 2 depicts one example of the circular loudspeaker array 102 that forms a portion of the system 100 of FIG. 1 in accordance with one embodiment. The example circular loudspeaker array 102 as shown in connection with FIG. 2 includes a total of 8 loudspeakers **120*a*-120*h*. However, it is recognized that any number of loudspeakers may be utilized in the array 102. The loudspeakers 120*a*-120*h* are uniformly distributed along a horizontal plane 122. In general, each loudspeaker 120*a*-120*h* may radiate a similar amount of sound energy all forward facing direction when the loudspeaker array 102 is in the omnidirectional sound mode. In the beamforming mode, any one or more of the loudspeakers 120*a*-120*h* may be controlled to play the audio output at different volumes, delay the audio output thereof or be completely shut off while transmitting the processed audio output. It is recognized that the arrangement and structure of the loudspeakers 120*a*-120*h* need to be strategically positioned, since the sound radiation of the loudspeakers 120*a*-120*h* are often interfered with each other and a combing filtering will hence appear in the frequency response. Additionally, the sound field may not be spatially uniform and omnidirectional. To avoid these issues, some special acoustics structure may be required, such as horn structure, to smooth the transition of the frequency response of the adjacent loudspeakers 120*a*-120*h***.

Figure 3:
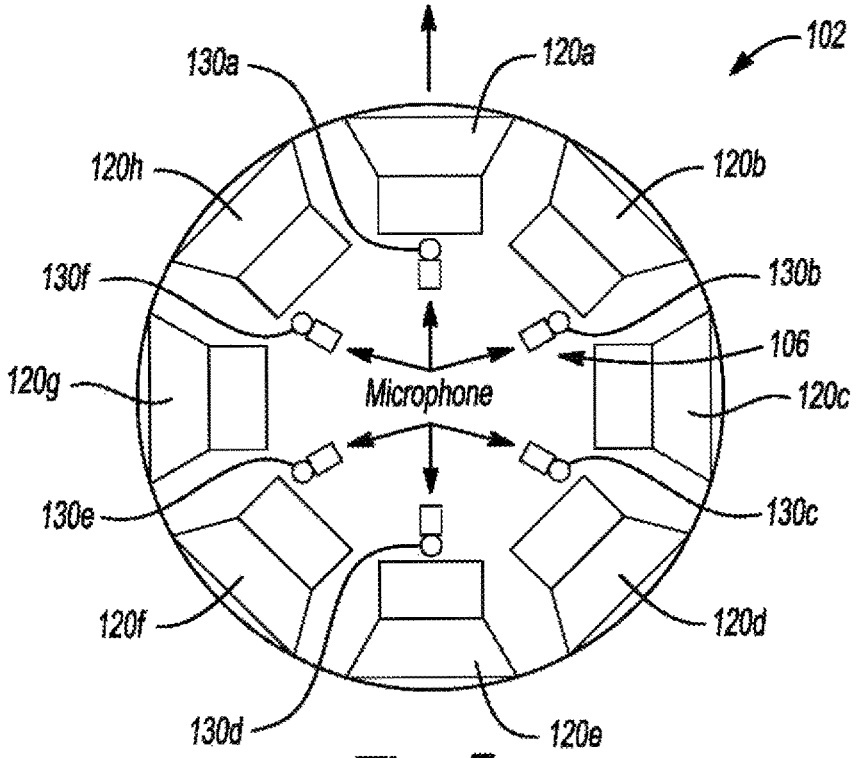
FIG. 3 depicts one example of a six-element microphone array along with the circular loudspeaker array that forms a portion of the system of FIG. 1 in accordance with one embodiment.
Figure 4:
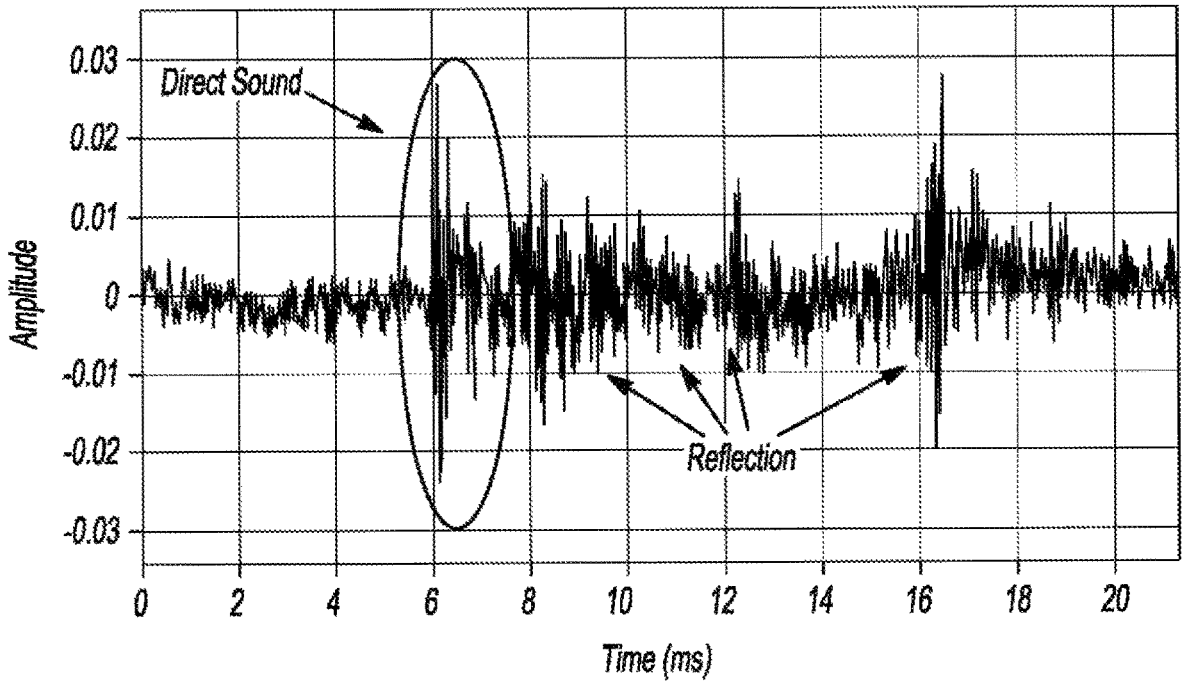
FIG. 4 depicts a waveform that illustrates direct sound and reflections.

FIG. 3 depicts one example of a six-element microphone array 106 along with the circular loudspeaker array 102 that forms a portion of the system 100 of FIG. 1 in accordance with one embodiment. The microphone array 106 may be positioned on top of the loudspeaker array 102. The array 106 as illustrated in FIG. 3 may include, for example, 6 microphones **130*a*-130*f* that are positioned on an outer perimeter of the array 106. As for sound reflection detection as performed by the system 100, the microphone array 106 may need to be implemented in a circular array and uniformly distributed as generally shown in FIG. 3 to record sound from the loudspeakers 120*a*-120*h* and the reflections. The microphone array 106 is generally configured to record all of the sound output by the loudspeaker array 102 including direct sound and reflection sound. The direct sound is distinguishable from reflection sound (i.e., reflections). This is shown in reference to FIG. 4** where direct sound is clearly distinguishable from the reflection.

Referring back to FIG. 3, while in some cases it may be desirable to distribute the microphones **130*a*-130*f* uniformly, it is recognized that this may be optional and that non-uniform implementations may be pursued as well. When the loudspeaker array 102 is powered on, or sound detection is triggered via the controller 104, the loudspeaker array 102 is generally placed in the omnidirectional sound mode. The microphone array 106 captures the audio and the controller 104 records the audio. The controller 104 converts the captured audio into a multi-channel signal which is then provided to the DSP 109** for signal processing.

The loudspeaker array 102 may include any number of loudspeakers 120, M that is greater than, or equal to two. Similarly, the microphone array 106 may include any number of microphones, N that is greater than, or equal to two.

Thus, the combination of M loudspeakers 120 and N microphones 130 will be able to form K direction of microphone beams where K is greater than 1. For the example illustrated in FIG. 3, K=12 twelve beams or vectors. In general, K is arbitrary and can be set to a value that is most desired. The greater the number of beams K, the greater the computational needs may be required by the DSP 109.

Figure 5:
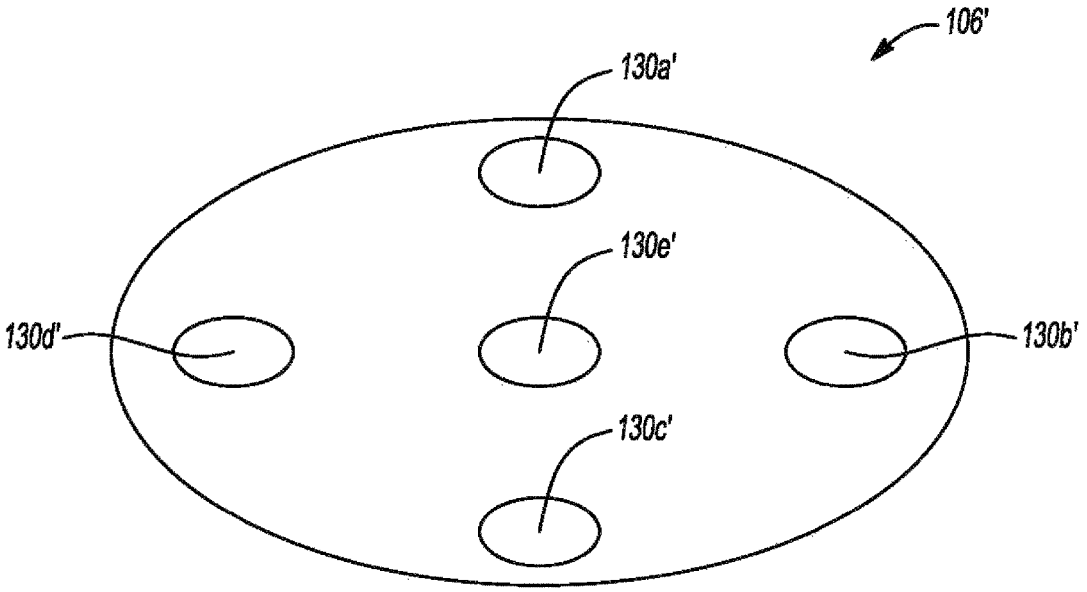
FIG. 5 depicts another example of a microphone array in accordance with one embodiment.

FIG. 5 depicts another example of the microphone array 106' in accordance with one embodiment. The microphone array 106' may, for example, include 5 microphones 130*a*'-130*e*'. In particular, the microphone 130*e*' may be positioned generally in a center of the array 106' and the microphone 130*e*' may be surrounded by microphones 130*a*'-130*e*'. In this regard, all of the microphones 130*a*'-130*e*' may not be radially formed on an outer perimeter of the array 106 when compared to the array 106 as illustrated in FIG. 3.

Figure 6:
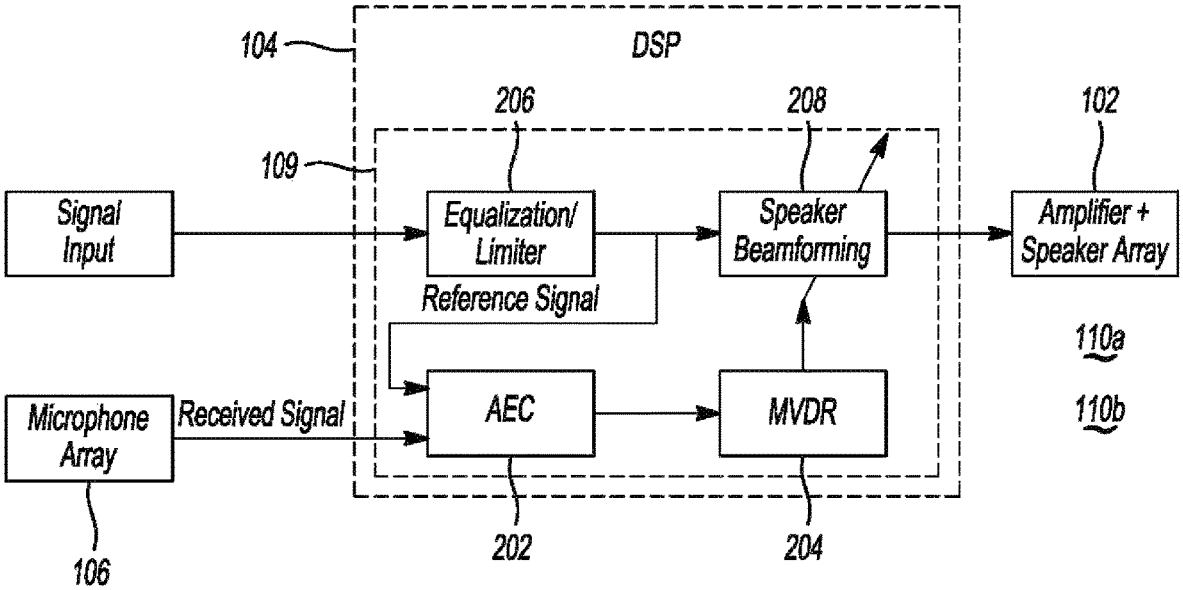
FIG. 6 depicts a schematic diagram of a digital signal processing (DSP) implementation that is implemented by the system of FIG. 1 in accordance with one embodiment.

FIG. 6 depicts a schematic diagram of the controller 104 and more specifically to the DSP 109 that is implemented by the system 100 of FIG. 1 in accordance with one embodiment. The DSP 109 generally includes a first processing stage 202 and a second processing stage 204. The first processing stage 202 may be implemented as an acoustic echo canceller (AEC) block. The second processing stage 204 may be implemented as a minimum variance distortion less response (MVDR) block. The second processing stage 204 may also be implemented as, but not limited to, a General Sidelobe Canceler (GSC) block). The controller 104 generally includes any number of microprocessors to execute the first processing stage 202, the second processing stage 204, the equalization/limiter block 206, and the loudspeaker beamforming block 208.

The equalization/limiter block 206 receives the incoming audio signal and equalizes the same to generate a reference signal that is provided to the loudspeaker beamforming block 208 and the first processing stage 202. The first processing stage 202 also receives an output signal from the microphone array 106 (i.e., received signal) which corresponds to the captured audio output in the room 108. In general, the first processing stage 202 may extract acoustic impulse responses from the reference signal and the received signal as provided by the loudspeaker array 102.

Equation (1) as set forth below includes the reference signal as defined by r(n) (or the speaker playing signal as provided by the equalization limiter block 206), and a $j^{th}$ microphone input signal $m_j(n)$ containing a background signal v(n) (as received from the microphone array 106 via the received signal). Thus, the first processing stage 202 (e.g., the AEC block) may compute the $j^{th}$ unknown impulse responses $h_j(n)$ based on the following, $$m_j(n)=r(n)*h_j(n)+v(n) \tag{1}$$

where * is the convolution operator. Since the background signal and the reference signal is usually uncorrelated, it is possible to reduce the background signal while obtaining the impulse responses $h_j(n)$ by using an adaptive algorithm, such as, for example, a Normalized Least-Mean-Square (NLMS) algorithm as expressed as, $$e_j(n) = m_j(n) - r(n) * \hat{h}_j(n) \tag{2}$$

$$\widehat{h_{j_update}}(n) = \hat{h}_j(n) + \mu_{NLMS}\frac{e_j(n)r(n)}{\|r(n)\|^2 + \delta_{NLMS}} \tag{3}$$

where $e_j(n)$, $\hat{h}_j(n)$, $\mu_{NLMS}$ and $\delta_{NLMS}$ are the instantaneous estimation error, NLMS adaptively estimated impulse response, step size with the range 0 to 2 and a small positive constant used to avoid division by zero, respectively.

The first processing stage 202 may then transmit the impulse responses e.g., $\widehat{h_{j_update}}$ (n) to the second processing stage 204. As noted above, the second processing stage 204 may employ MVDR that is provided by, $$w_{opt}=R_{hh}^{-1}f(f^H R_{hh}^{-1}f)^{-1} \tag{4}$$

where $R_{hh}$ is an autocorrelation matrix of the impulse responses, and f is a desired response vector, which is determined by the detected angles of the sound in 360 degrees. The second processing stage 204 is generally configured to minimize a variance of the received signal. When the controller 104 is programmed or set to a target detection angle, the MVDR block (or the second processing stage 204) may maximize the signal received from the programmed direction while minimizing the signal from other directions. If there is a wall 110 in this direction with respect to the microphone array 106 (or the loudspeaker array 102 since the microphone array 106 is attached thereto), the sound reflection may be stronger, and the second processing stage 204 (or the MVDR block) may detect and distinguish this reflection signal. Therefore, we can determine which direction the wall 110 is most likely to be. Speaker beamforming may be bypassed at this point until the location (e.g., distance, angle, etc.) of the wall 110 relative to the array 102 is known. The target detection angle may also be known as the microphone beamforming angle which is determined by the performance of the DSP 109 and/or criteria. The target detection angle is pre-defined and different from the desired response vector, f as set forth in equation (4) above. In general, microphone beamforming may be like a probe that requires instruction with respect to which direction to detect and analyze.

After the second processing stage 204 detects wall directions (e.g., distance, angle) relative to the 360 degrees circular array of loudspeakers (or the loudspeaker array 102), the controller 104 then ceases to perform wall detection and waits for a next detection trigger event to initiate performing wall detection in the event this operation is being requested again by a user. After wall detection, the controller 104 activates the loudspeaker beamforming block 208 to set a beamforming target angle according to the direction of the wall 110 that is closest to the loudspeaker array 102. For example, the loudspeaker beamformer block 208 may execute a speaker beamforming algorithm and utilize a weighted delay-and-sum approach which is given by, $$y(n)=\Sigma_{i=0}^{N-1}w_i x(n-\tau_i) \tag{5}$$

where N, $w_i$, x, y and $\tau_i$ are the number of microphones, weight of the $i^{th}$ speaker, input signal, output signal and the delay for the $i^{th}$ microphone, respectively.

Hence, if the controller 104 detects the wall 110 or other obstacle at 0 degrees, the controller 104 may select the beamforming target angle at 180 degrees to avoid reflection causing the sound coloration. On the other hand, if the controller 104 detects the wall 110 or other obstacle at a far distance from the microphone array 106 (or from the loudspeaker array 102), the controller 104 may bypass the beamforming mode and control the audio output from the loudspeaker array 102 to remain in the omnidirectional sound mode, as a 360-degree loudspeaker. In one example, a distance that is less than one meter to the wall 110 may be adequate to transition the sound mode of the system 100 from the omnidirectional mode into the beamforming mode. Otherwise, the system 100 remains in the omnidirectional mode.

For the sake of clarification, it is recognized that the controller 104 may determine the location of any one or more walls 110 with respect to the loudspeaker array 102 and also enter into the beamforming mode to transmit the audio from any number of the walls 110 that are closest to the loudspeaker array 102. Assuming, for example, that the controller 104 determines that both a first wall 110*a* and a second wall 110*b* are positioned within a predetermined distance (e.g., one meter) of the loudspeaker array 102, the controller 104 enters into the beamforming mode and transmits the audio output signal away from each of the first wall 110*a* and the second wall 110*b*. In this case, the controller 104 provides a first beamforming pattern to direct the audio output signal away from the first wall 110*a* and also provides a second beamforming pattern to direct the audio output signal away from the second wall 110*b*.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for providing an adaptive loudspeaker assembly, the system comprising:

a loudspeaker array for transmitting an audio output signal in an omnidirectional sound mode in a room having a plurality of walls;

a microphone array being coupled to the loudspeaker array to capture the audio output signal in the room; and at least one controller programmed to:

receive the captured audio output signal;

determine that at least one first wall of the plurality of walls is closest to the loudspeaker array based on the captured audio output signal; and change a sound mode of the loudspeaker array from transmitting the audio output signal in the omnidirectional mode into a beamforming sound mode to transmit the audio output signal away from the at least one first wall of the plurality walls, wherein the at least one controller includes a first processing stage programmed to:

receive a captured audio signal including background noise from the microphone array and a reference signal indicative of an equalized audio input prior to the loudspeaker array transmitting the audio output signal; and wherein the background noise and the reference signal are uncorrelated and the at least one controller executes an adaptive algorithm to reduce the background noise on the captured audio signal prior to determining that the at least one first wall of the plurality of walls is closest to the loudspeaker array.

2. The system of claim 1, wherein the loudspeaker array includes a plurality of loudspeakers being radially formed on a perimeter of the loudspeaker array.

3. The system of claim 2, wherein each of the plurality of loudspeakers are configured to transmit the audio output signal at a same energy level in the omnidirectional mode.

4. The system of claim 2, wherein the at least one controller is further programmed to selectively delay the transmission of the audio output signal from one or more of the plurality of loudspeakers in the beamforming sound mode.

5. The system of claim 2, wherein the at least one controller is further programmed to deactivate the one or more of the plurality of loudspeakers in the beamforming sound mode.

6. The system of claim 1, wherein the microphone array includes one of a plurality of microphones being radially formed on an outer perimeter of the microphone array or a plurality of microphones surrounding a central microphone thereof.

7. The system of claim 1, wherein the first processing stage is programmed to extract acoustic impulse responses from the reference signal and the captured audio signal after executing the adaptive algorithm to reduce the background noise on the captured audio signal.

8. The system of claim 7, wherein the at least one controller includes a second processing stage programmed to receive the extracted acoustic impulse responses and to determine a location of the at least one first wall that is closest to the loudspeaker array based at least on the extracted acoustic impulse responses.

9. The system of claim 8, wherein the second processing stage is one of a minimum variance distortion less response (MVDR) block or a general sidelobe canceler (GSC) block.

10. A method for providing an adaptive loudspeaker assembly, the method comprising:

transmitting, a loudspeaker array, an audio output signal in an omnidirectional sound mode in a room having a plurality of walls;

capturing, via a microphone array, the audio output signal in the room;

determining with at least one controller that at least one first wall of the plurality of walls is closest to the loudspeaker array based on the captured audio output signal; and changing a sound mode of the loudspeaker array from transmitting the audio output signal in the omnidirectional mode into a beamforming sound mode to transmit the audio output signal away from the at least one first wall of the plurality walls;

receiving by the at least one controller, a captured audio signal including background noise from the microphone array and a reference signal indicative of an equalized audio input prior to the loudspeaker array transmitting the audio output signal, wherein the background noise and the reference signal are uncorrelated; and executing an adaptive algorithm by the at least one controller to reduce the background noise on the captured audio signal prior to determining that the at least one first wall of the plurality of walls is closest to the loudspeaker array.

11. The method of claim 10, wherein the loudspeaker array includes a plurality of loudspeakers being radially formed on a perimeter of the loudspeaker array.

12. The method of claim 11, wherein each of the plurality of loudspeakers are configured to transmit the audio output signal at a same energy level in the omnidirectional mode.

13. The method of claim 11 further comprising selectively delaying the transmission of the audio output signal from one or more of the plurality of loudspeakers in the beamforming sound mode.

14. The method of claim 11 further comprising deactivating the one or more of the plurality of loudspeakers in the beamforming sound mode.

15. The method of claim 10, wherein the microphone array includes one of a plurality of microphones being radially formed on an outer perimeter of the microphone array or a plurality of microphones surrounding a central microphone thereof.

16. A system for providing an adaptive loudspeaker assembly, the system comprising:

a circular loudspeaker array for transmitting an audio output signal in an omnidirectional sound mode in a room having a plurality of walls;

a circular microphone array being coupled to the circular loudspeaker array to capture the audio output signal in the room; and at least one controller programmed to:

receive the captured audio output signal indicating a plurality of sound reflections from the plurality of walls;

determine that at least one first wall of the plurality of walls is closest to the circular loudspeaker array based on a first sound reflection from the at least one first wall being the strongest reflection out of the plurality of sound reflections; and change a sound mode of the circular loudspeaker array from transmitting the audio output signal in the omnidirectional mode into a beamforming sound mode to transmit the audio output signal away from the at least one first wall of the plurality walls, wherein the at least one controller is further programmed to:

receive a captured audio signal including background noise from the microphone array and a reference signal indicative of an equalized audio input prior to the circular loudspeaker array transmitting the audio output signal; and wherein the background noise and the reference signal are uncorrelated and the at least one controller executes an adaptive algorithm to reduce the background noise on the captured audio signal prior to determining that the at least one first wall of the plurality of walls is closest to the loudspeaker array.

17. The system of claim 16, wherein the circular loudspeaker array includes a plurality of loudspeakers that are each configured to transmit the audio output signal at a same energy level in the omnidirectional mode.

18. The system of claim 17, wherein the at least one controller is further programmed to selectively delay the transmission of the audio output signal to provide a first beamforming pattern to transmit the audio output signal away from the first wall and to provide a second beamforming pattern to transmit the audio output signal away from a second wall of the plurality of walls in the event the first wall and the second wall are determined to be the closest to the circular loudspeaker array.

* * * * *